US011345182B2

(12) United States Patent
Boettcher et al.

(10) Patent No.: US 11,345,182 B2
(45) Date of Patent: May 31, 2022

(54) ERASER ASSEMBLY AND ERASER INSERTS

(71) Applicant: Amazing Magnets, LLC, Anaheim, CA (US)

(72) Inventors: Timothy Paul Boettcher, Orange, CA (US); Luke T. Bilisoly, Fullerton, CA (US)

(73) Assignee: Amazing Magnet, LLC, Anaheim, CA (US)

( * ) Notice: Subject to any disclaimer, the term of this patent is extended or adjusted under 35 U.S.C. 154(b) by 43 days.

(21) Appl. No.: 16/514,154

(22) Filed: Jul. 17, 2019

(65) Prior Publication Data

US 2020/0023671 A1 Jan. 23, 2020

Related U.S. Application Data

(60) Provisional application No. 62/699,507, filed on Jul. 17, 2018.

(51) Int. Cl.
*B43L 21/00* (2006.01)
*B43L 19/00* (2006.01)
(Continued)

(52) U.S. Cl.
CPC ..... *B43L 21/00* (2013.01); *B43L 19/0062* (2013.01); *A47L 1/15* (2013.01); *A47L 13/00* (2013.01)

(58) Field of Classification Search
CPC ..... B43L 21/00; B43L 19/0062; B43L 21/04; B43L 21/02; A47K 7/02; A47K 7/028;
(Continued)

(56) References Cited

U.S. PATENT DOCUMENTS 505,733 A 9/1893 Torrey
1,943,647 A 1/1934 Weller
(Continued)

FOREIGN PATENT DOCUMENTS

CN 204095369 1/2015
EP 1 543 993 A1 6/2005
(Continued)

OTHER PUBLICATIONS

International Preliminary Report on Patentability in International Application No. PCT/US2017/047923, dated Feb. 26, 2019 in 11 pages.
(Continued)

*Primary Examiner* — Katina N. Henson
(74) *Attorney, Agent, or Firm* — Knobbe Martens Olson & Bear, LLP

(57) ABSTRACT

An eraser assembly is provided that includes a housing, a tray, a coupler, and an eraser insert. The housing has a concave shape including an interior portion. The tray has a retaining portion disposed in the interior portion of the housing and a mounting portion disposed opposite the retaining portion. The coupler is configured to releasably hold the tray to the housing. The eraser insert is configured to be mounted to the mounting portion. An eraser insert is also provided that includes a first side and a second side, an eraser pad, and a coupler. The first side includes a mounting surface and an eraser pad is disposed on the second side. The coupler is disposed on or about the mounting surface and is configured to detachably connect the eraser insert to an eraser assembly at the mounting surface.

20 Claims, 15 Drawing Sheets

(51) Int. Cl.
*A47L 13/00* (2006.01)
*A47L 1/15* (2006.01)

(58) Field of Classification Search
CPC ..... A47L 13/46; A47L 13/16; A47L 13/00; A47L 1/09; A47L 1/15; A47L 13/17; A47L 25/00
See application file for complete search history.

(56) References Cited

U.S. PATENT DOCUMENTS

| | | | |
|---|---|---|---|
| 2,297,806 | A | 10/1942 | Smith |
| 2,385,859 | A | 10/1945 | Jacobson |
| 2,644,212 | A | 7/1953 | Markowitz |
| 2,964,812 | A | 12/1960 | Cook |
| 3,159,372 | A | 12/1964 | McIntosh |
| 3,387,341 | A | 6/1968 | Mates et al. |
| 4,941,226 | A | 7/1990 | Kemper |
| 5,083,337 | A | 1/1992 | Jones |
| 6,199,240 | B1 | 3/2001 | You |
| D441,021 | S | 4/2001 | Roush |
| 6,305,864 | B1 | 10/2001 | Nguyen |
| 6,718,708 | B2 | 4/2004 | Donoghue |
| D493,836 | S | 8/2004 | Cegelski et al. |
| 6,846,122 | B1 | 1/2005 | Liao |
| 6,945,503 | B2 | 9/2005 | Cohen |
| 7,264,414 | B2 | 9/2007 | McReynolds et al. |
| 7,313,841 | B2 | 1/2008 | Huang |
| 7,496,994 | B1 | 3/2009 | Headley |
| 7,527,447 | B2 | 5/2009 | Huang |
| 7,618,013 | B2 | 11/2009 | Elmer et al. |
| 8,235,262 | B1 | 8/2012 | Sakdol |
| 8,439,585 | B2 | 5/2013 | Rubio |
| 8,464,447 | B2 | 6/2013 | Pemberton |
| 9,153,152 | B1 | 10/2015 | Elmer |
| 9,161,586 | B2 | 10/2015 | Brown |
| 9,320,409 | B1 | 4/2016 | Lu et al. |
| 9,409,437 | B2 | 8/2016 | Green et al. |
| 9,662,926 | B1 | 5/2017 | Boettcher et al. |
| 10,220,649 | B2 | 3/2019 | Boettcher et al. |
| 2004/0205919 | A1 | 10/2004 | Sims |
| 2005/0251942 | A1 | 11/2005 | Gunnarsson |
| 2006/0000043 | A1 | 1/2006 | Jou-Chen |
| 2006/0194028 | A1 | 8/2006 | Moore |
| 2007/0014624 | A1 | 1/2007 | Fogelson et al. |
| 2007/0194187 | A1 | 8/2007 | Amron |
| 2008/0166173 | A1 | 7/2008 | Gibbons |
| 2008/0240840 | A1 | 10/2008 | Huang |
| 2009/0126137 | A1 | 5/2009 | Lyons |
| 2009/0193629 | A1 | 8/2009 | Suenaga |
| 2010/0068422 | A1 | 3/2010 | Keyes |
| 2010/0219217 | A1 | 9/2010 | Andochick |
| 2011/0091860 | A1 | 4/2011 | Supera et al. |
| 2013/0306206 | A1 | 11/2013 | Quinnan |
| 2016/0186789 | A1 | 6/2016 | Nelson et al. |
| 2016/0220088 | A1* | 8/2016 | Zohar ..... A47L 13/17 |
| 2017/0259612 | A1 | 9/2017 | Boettcher et al. |
| 2018/0056710 | A1 | 3/2018 | Boettcher et al. |
| 2020/0384795 | A1 | 12/2020 | Boettcher et al. |

FOREIGN PATENT DOCUMENTS

| | | |
|---|---|---|
| EP | 3 067 876 B1 | 12/2017 |
| EP | 3 079 140 B1 | 10/2018 |
| FR | 2 825 594 | 12/2002 |
| GB | 273413 A | 7/1927 |
| KR | 20-0321360 | 7/2003 |
| KR | 10-0946430 | 3/2010 |
| KR | 10-2013-0137873 | 12/2013 |
| WO | WO 2017/083374 | 5/2017 |
| WO | WO 2018/039177 | 3/2018 |

OTHER PUBLICATIONS

International Search Report and Written Opinion issued in PCT Application No. PCT/US2017/047923, dated Dec. 4, 2017 in 15 pages.

"The StikkiWorks Co.—Magnetic Marker Rings", http://www.stikkiworks.com/prodring, printed from the internet Dec. 11, 2015.

* cited by examiner

ERASER ASSEMBLY AND ERASER INSERTS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57. Each of U.S. Provisional Application No. 62/699,507, filed Jul. 17, 2018, U.S. Provisional Application No. 62/378,354, filed Aug. 23, 2016, and U.S. application Ser. No. 15/682,819, filed Aug. 22, 2017, is hereby incorporated by reference herein in its entirety.

BACKGROUND

Field

The present disclosure relates to an eraser assembly for use on white boards, glass boards, and the like, and an eraser insert for use in an eraser assembly.

Description of the Related Art

Blackboards and whiteboards have long been in use. These devices provide a convenient space for instructors and meeting attendees to record their thoughts for a group using chalk and pens. Whiteboard, and more recently glassboards, have gained popularity as more convenient and cleaner to use than blackboards. Glassboards, which are gaining in popularity form part of, or are mounted to a wall surface. A layer of glass is the structure upon which the user writes. These devices improve on whiteboards in being more durable, and being more aesthetically pleasing with a sleek, modern look.

A conventional way to clean such boards is to use an eraser to rub the surface of the board. The surface of the eraser that rubs the board is configured to remove the markings from the board to clean the board for subsequent use. The conventional black or whiteboard eraser serves this function reasonably well. However because the surface of the eraser that rubs the surface of the board is generally integrally formed with or non-removably secured to the body of the eraser that the user grips the useful life of the entire eraser is limited by the durability of the surface that rubs the board. While a user can try to extend the life of the eraser, the board cleaning capacity of the eraser will steadily decline. While a user is free to frequently replace the entire eraser, this practice leads to waste, expense and inventory management issues, particularly for a school or large office with a large number of rooms and black, white or glass boards.

SUMMARY

Accordingly, there is a need for an improved eraser for cleaning black, white, and glassboards and other similar boards that is more long lasting. The eraser preferably enables a user to quickly change the surface that rubs the board for cleaning the board. The eraser can be in the form of an assembly which can have an eraser insert mounted thereto. The eraser can be in the form of an assembly which can store one or more eraser inserts therein to reduce inventory issues. The eraser can be in the form of an assembly that facilitates the re-use of at least some of the components of the eraser in a convenient and economical way. There is also a need for eraser inserts that can be supplied for use with an eraser assembly to further facilitate the convenient re-use of at least some of the components of the eraser.

In one embodiment, an eraser assembly is provided that includes a housing, a tray, a coupler, and an eraser insert. The housing has a concave shape that includes an interior portion. The tray has a retaining portion disposed in the interior portion of the housing and a mounting portion disposed opposite the retaining portion. The coupler is configured to releasably hold the tray to the housing. The eraser insert is configured to be mounted to the mounting portion.

In another embodiment, an eraser insert is provided that includes a first side and a second side, an eraser pad, and a coupler. The first side of the insert includes a mounting surface. The eraser pad is disposed on the second side of the insert. The coupler is disposed on or about the mounting surface and is configured to detachably connect the eraser insert to an eraser assembly at the mounting surface.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
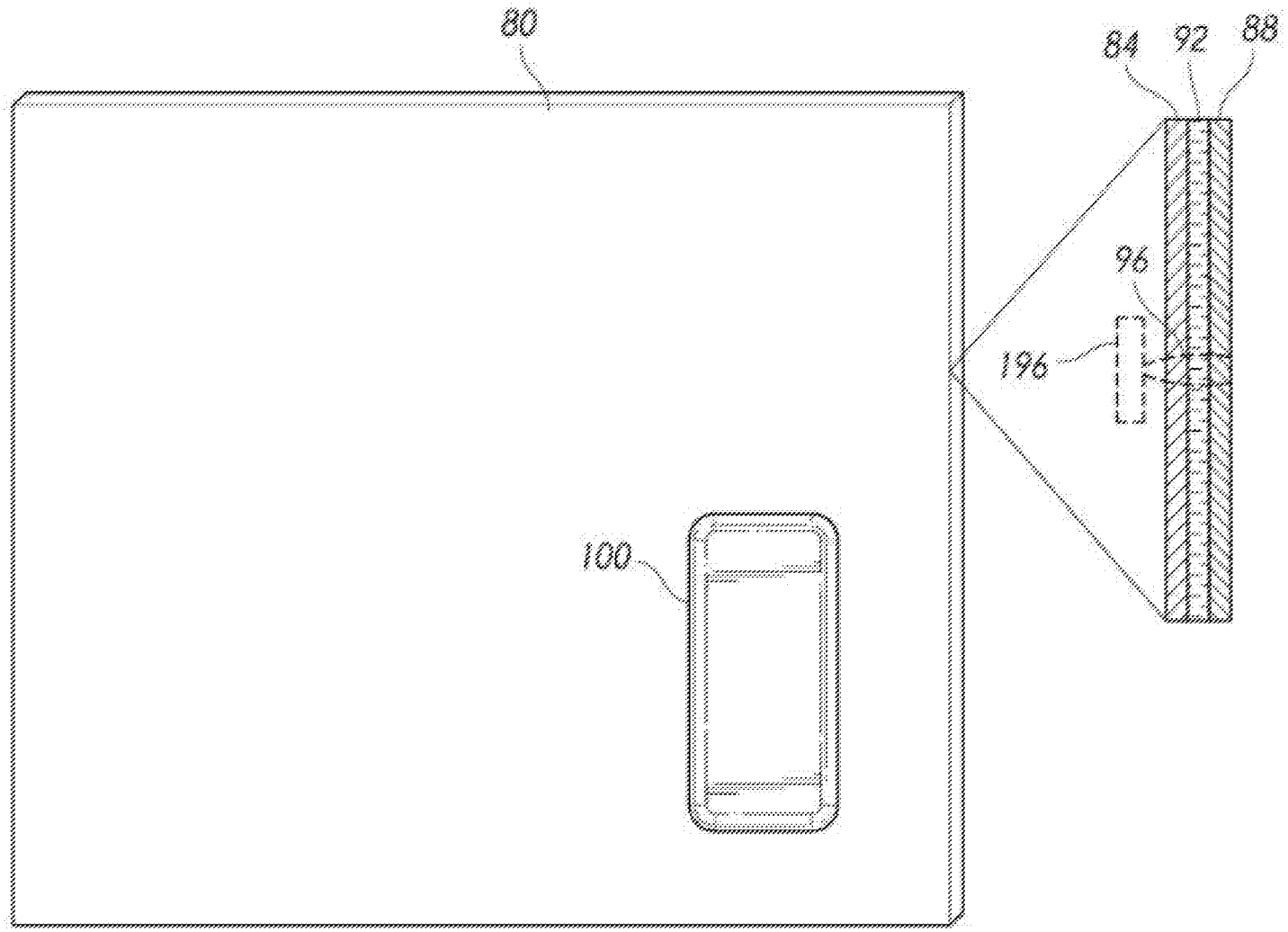
FIG. 1 illustrates an environment for use of an eraser assembly and also illustrates a system including a marking board and an eraser assembly.

FIG. 1 shows an eraser assembly 100 stored on a board 80, the eraser assembly 100 self-supported by magnet(s) 196. This can eliminate the need for a tray for storing an eraser and can reduce the chance that the eraser assembly 100 will be lost or unavailable in use. The strength of the magnet(s) 196 can enable the user to apply less force into the board 80 when wiping or cleaning the board 80 and can make wiping or cleaning more effective. Further details of the magnet(s) 196 are discussed below in connection with FIG. 4.

FIGS. 2-7 show an embodiment of an eraser assembly 300. The eraser assembly 300 includes a housing 304, a tray 308, a coupler 340, and an eraser insert 310. The eraser insert 310 can be a first eraser insert, should the eraser assembly 300 be configured to retain multiple inserts, as discussed further below.

Figure 3:
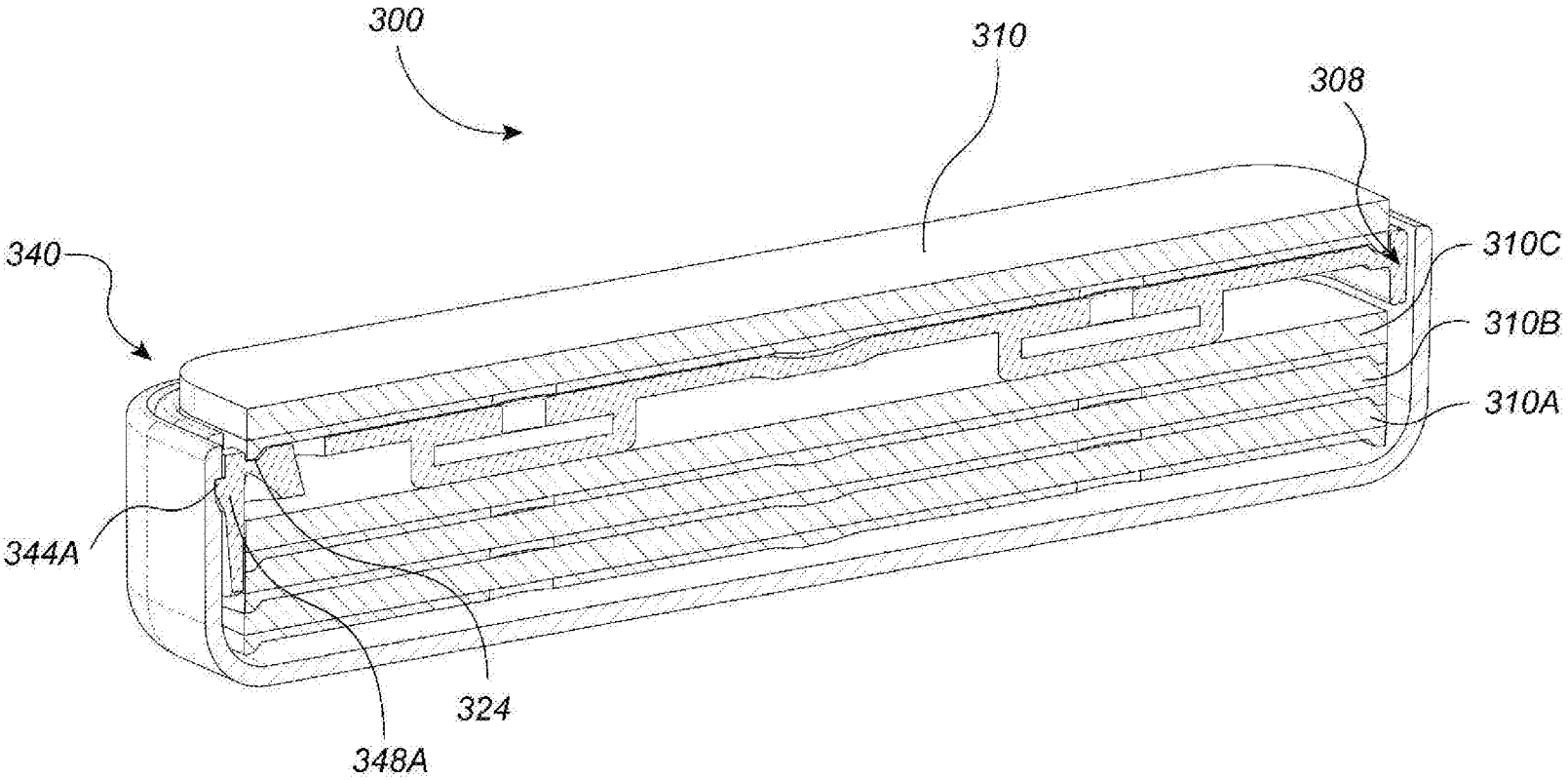
FIG. 3 is a cross-sectional view of the eraser assembly of FIG. 2.
Figure 5:
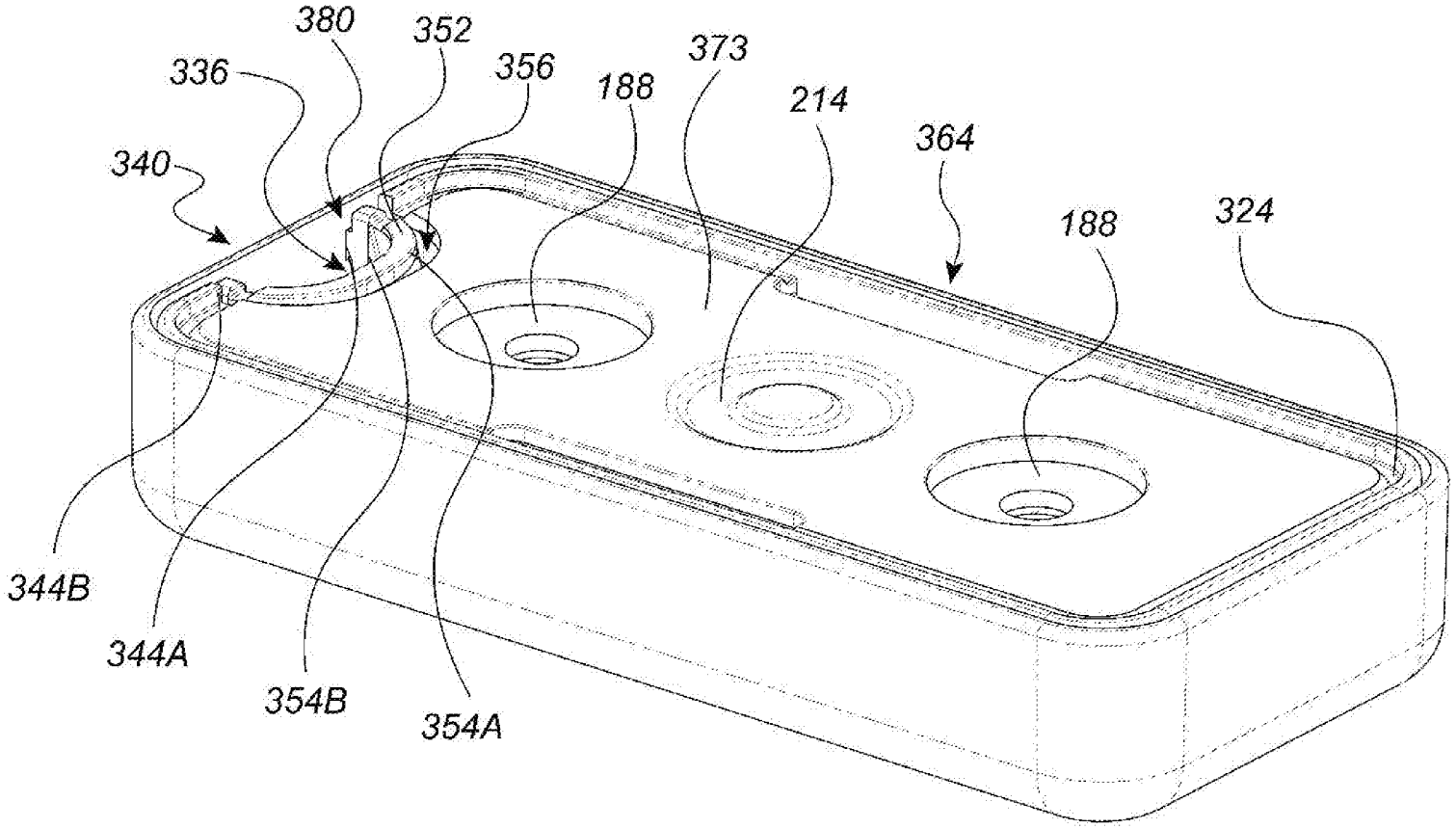
FIG. 5 is a bottom perspective view of the eraser assembly of FIG. 2.
Figure 6:
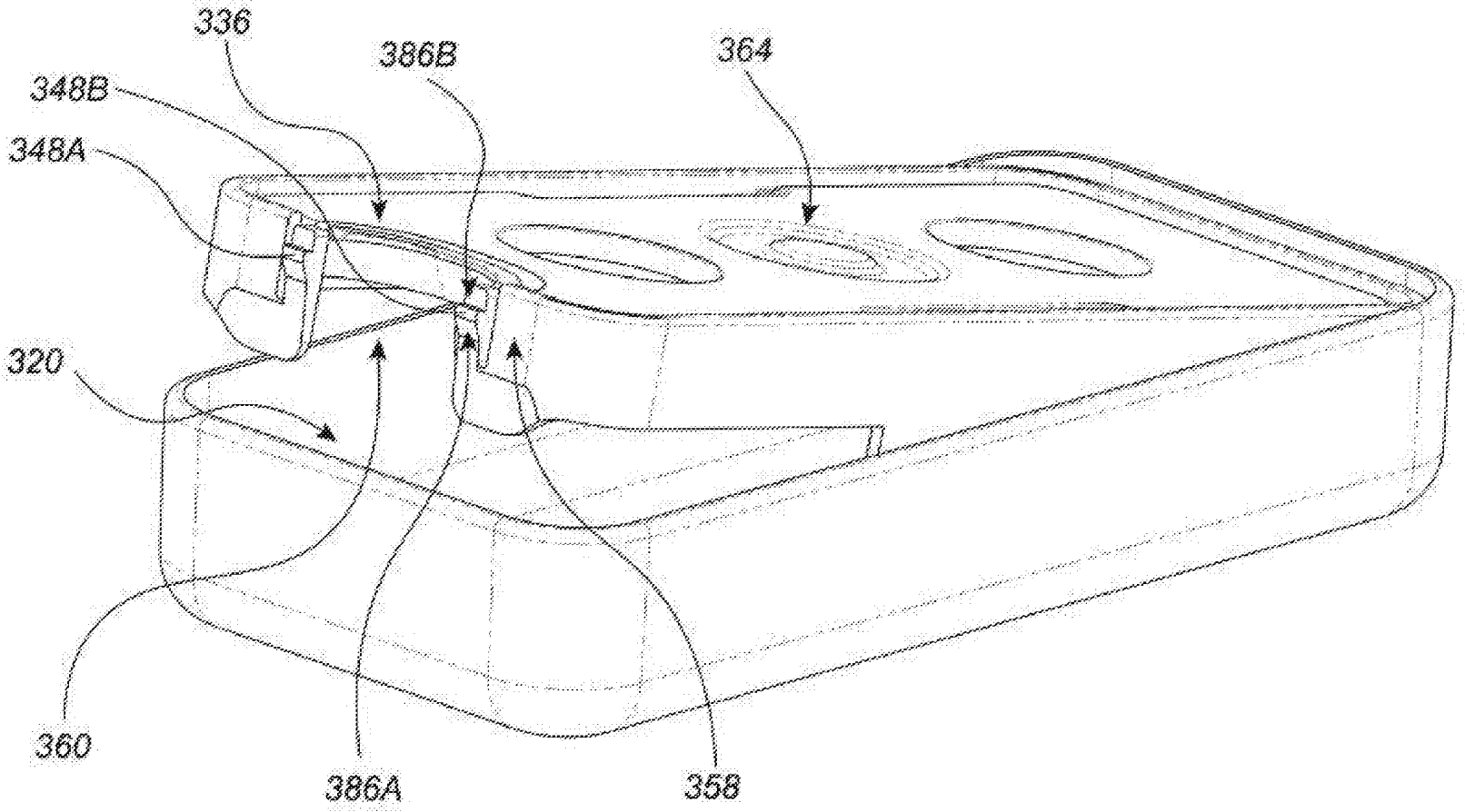
FIG. 6 is an exploded view of the eraser assembly of FIG. 2.

In some embodiments, the housing 304 has a concave shape that includes an interior portion 320. The interior portion 320 is disposed between a top surface and a plurality of outside surfaces 332. FIGS. 3, 5 and 6 show that, in some embodiments, a coupler 340 is provided for connecting the tray 308 to the housing 304. The coupler 340 can be configured to releasably hold the tray 308 to the housing 304. In some embodiments, the coupler 340 has a first engaged configuration and a second disengaged configuration. The tray 308 can move, e.g., rotate, relative to the housing 304 when the coupler 340 is in the disengaged configuration.

Figure 2:
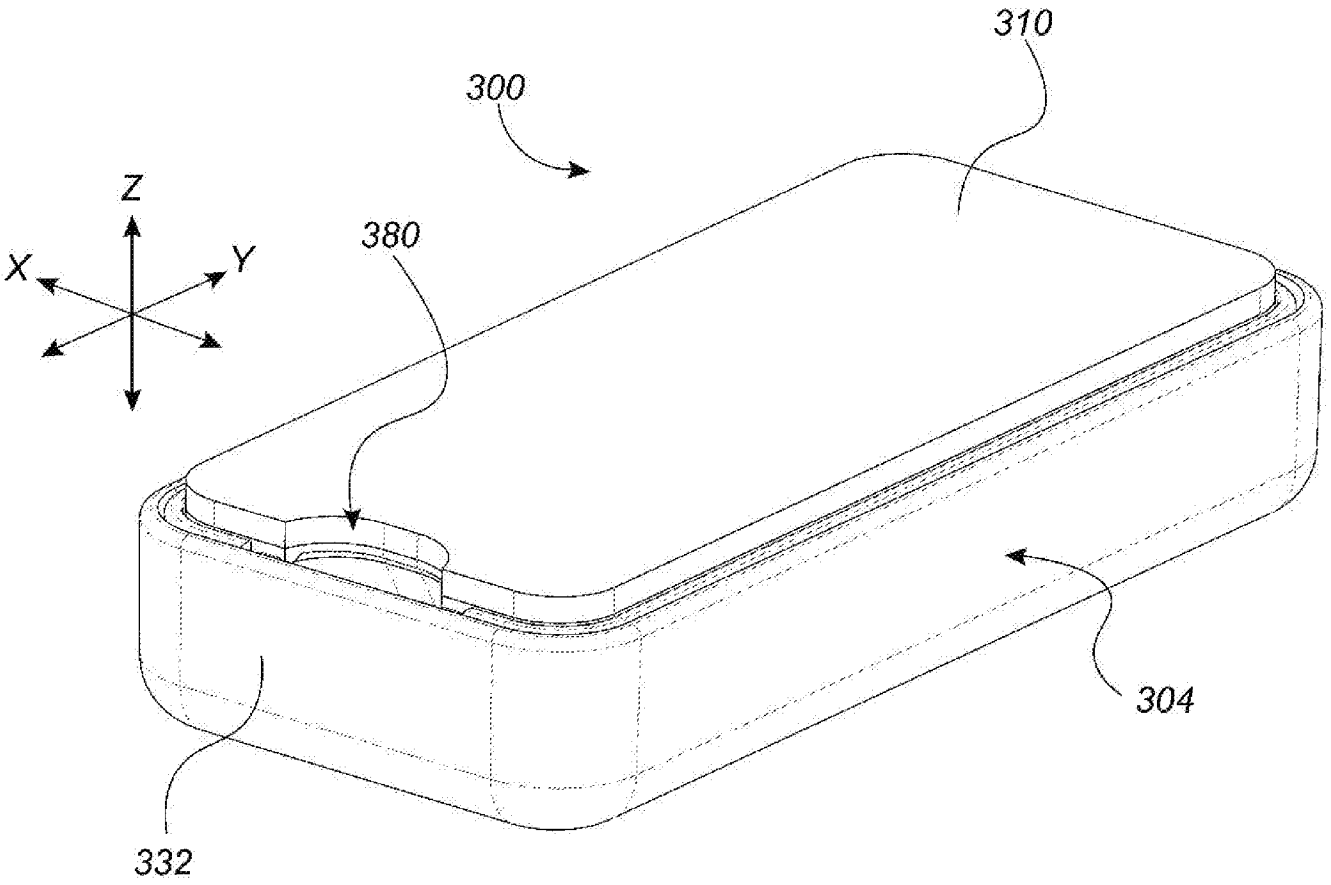
FIG. 2 is a bottom perspective view of an embodiment of an eraser assembly.

As shown in FIG. 2, in some embodiments, the eraser assembly 300 includes an aperture 380 for accessing the interior portion 320 of the housing 304. In some embodiments, the user can place a finger in the aperture 380 and pull the insert 310 away from the tray 308, removing the insert 310 from the eraser assembly 300 and obtaining access to the tray 308. In some embodiments, the user can place his finger in the aperture 380 and move the coupler 340 to the disengaged configuration, allowing the user to rotate the tray 308 away from the housing 304. In some embodiments, the coupler 340 can be moved to the disengaged configuration without removing the insert 310 from a mounting portion 364. In some embodiments, the aperture 380 extends through the eraser insert 310 into the interior portion 320 of the housing 304. In other embodiments, the insert 310 covers the aperture 380 until the insert is removed therefrom.

In some embodiments, the tray 308 comprises a retaining portion 360 and a mounting portion 364 disposed opposite of the retaining portion 360. FIG. 6 shows that the retaining portion 360 is disposed in the interior portion 320 of the housing 304 when the eraser assembly 300 is assembled. FIG. 5 shows that the mounting portion 364 is exposed when the tray 308 is coupled with the housing 304. More specifically, when the retaining portion 360 is disposed in the interior portion 320, the mounting portion 364 is exposed on an outside surface. This facilitates connecting the eraser insert 310 with the mounting portion 364. In some embodiments, the eraser insert 310 is configured to be mounted to the mounting portion 364. In some embodiments, the retaining portion 360 is disposed in the interior portion 320 and the mounting portion 364 is exposed on an outside surface. The eraser assembly 300 can be configured such that the eraser insert 310 can be disposed in the mounting portion 364. In some embodiments, more than one eraser insert 310A, 310B, 310C is provided and can be stored in the retaining portion 360.

Figure 7:
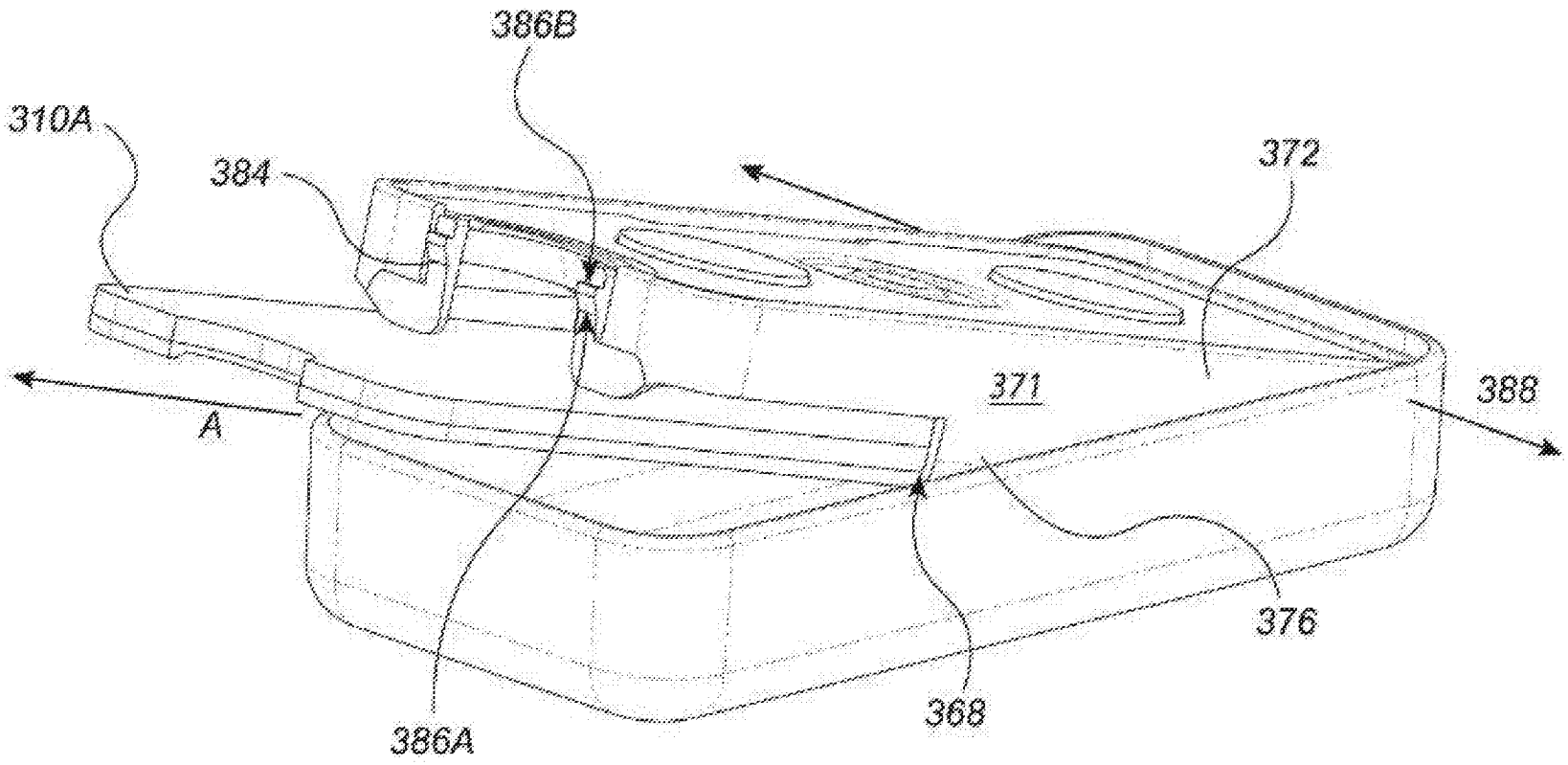
FIG. 7 is another exploded view of the eraser assembly of FIG. 2.
Figure 8:
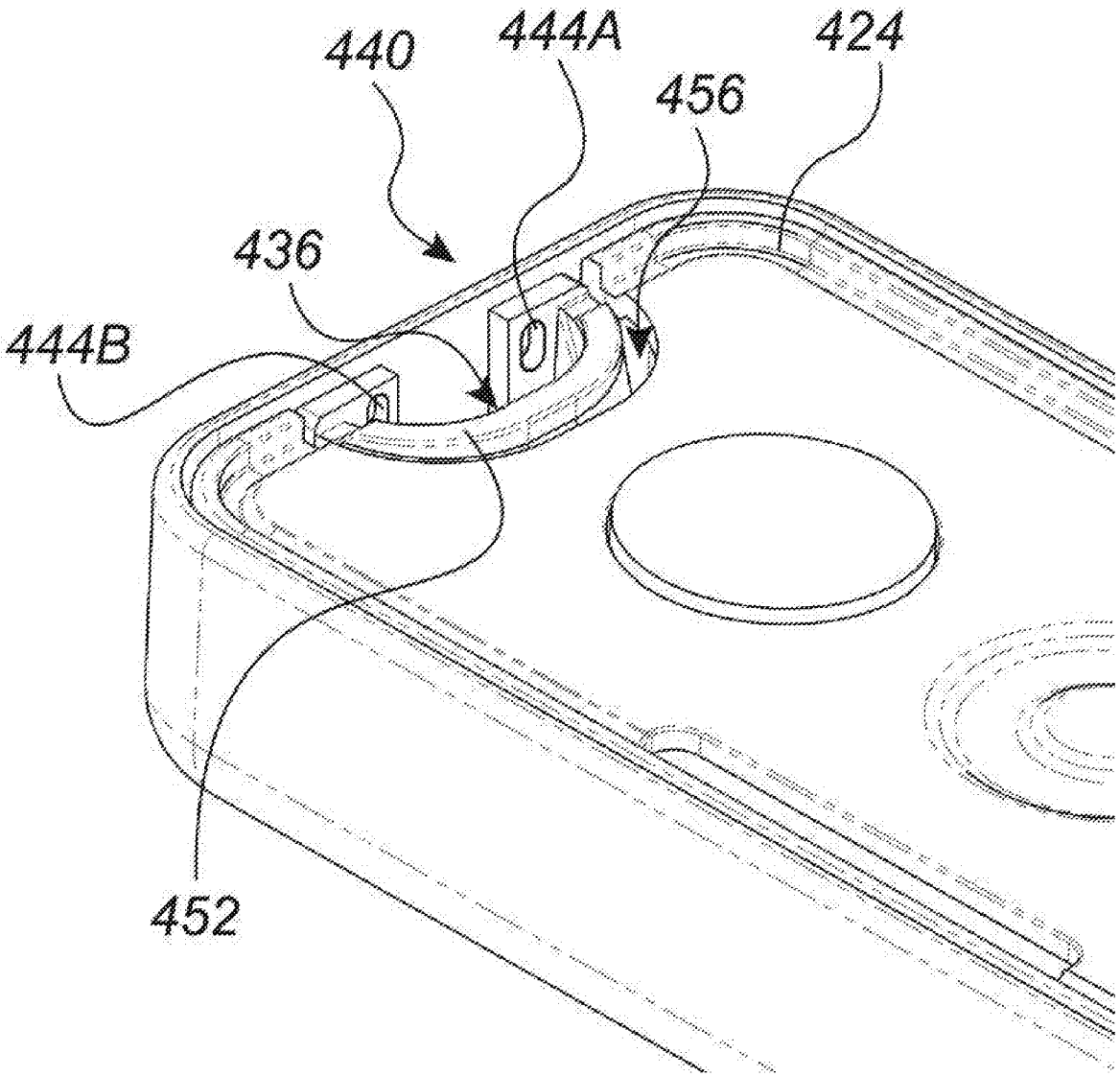
FIG. 8 is a detailed view of another embodiment of an eraser assembly.
Figure 9:
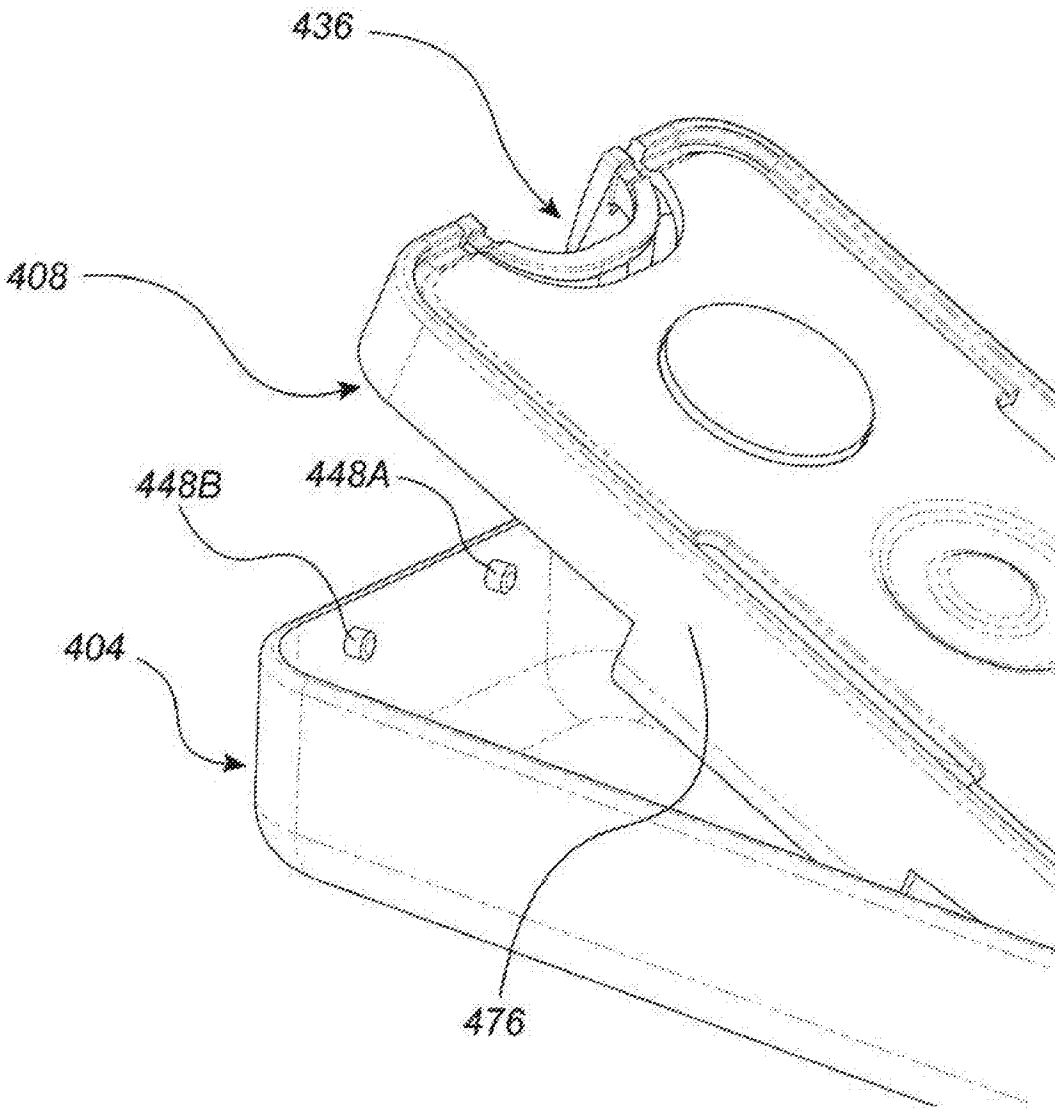
FIG. 9 is a detailed exploded view of the eraser assembly of FIG. 8.

FIG. 7 shows that the retaining portion 360 can include a holder 372 that is configured to at least partially surround or to surround at least a portion of the eraser inserts 310A, 310B, 310C when the inserts are disposed in the retaining portion 360. In some embodiments, the holder 372 includes one or a plurality of clips 376. The clips 376 can comprise elongate projections that extend from a side surface 371 of the tray 308. The clips 376 can extend to a location opposite the mounting portion 364 of the tray 308 such that end portions thereof extend generally parallel to a surface opposite a mounting surface 373 of the tray 308. The side opposite the surface 373 of the tray 308, a side of the clip 376 and the end portion of the clip 376 can surround three sides of the eraser inserts 310A, 310B, 310C. The clip 376 and an inside portion of the tray 308 can include a bight configuration to retain the inserts 310A, 310B, 310C.

As shown in FIG. 7, replacing the eraser insert 310 with one of the eraser inserts 310A, 310B, 310C disposed within the interior portion 320 can be achieved by pivoting the tray 308 out of the housing 304 about a rotational axis 388 extending perpendicular to the long side of the housing 304. In some embodiments, when the tray 308 is pivoted away from the housing 304, the end of the tray 308 adjacent to the clip 376 is exposed. This allows the user to grasp one of the inserts 310A, 310B, 310C through an access aperture 368 and pull the insert along the direction indicated by the arrow A in FIG. 7 to remove the insert from the tray 308.

Figure 4:
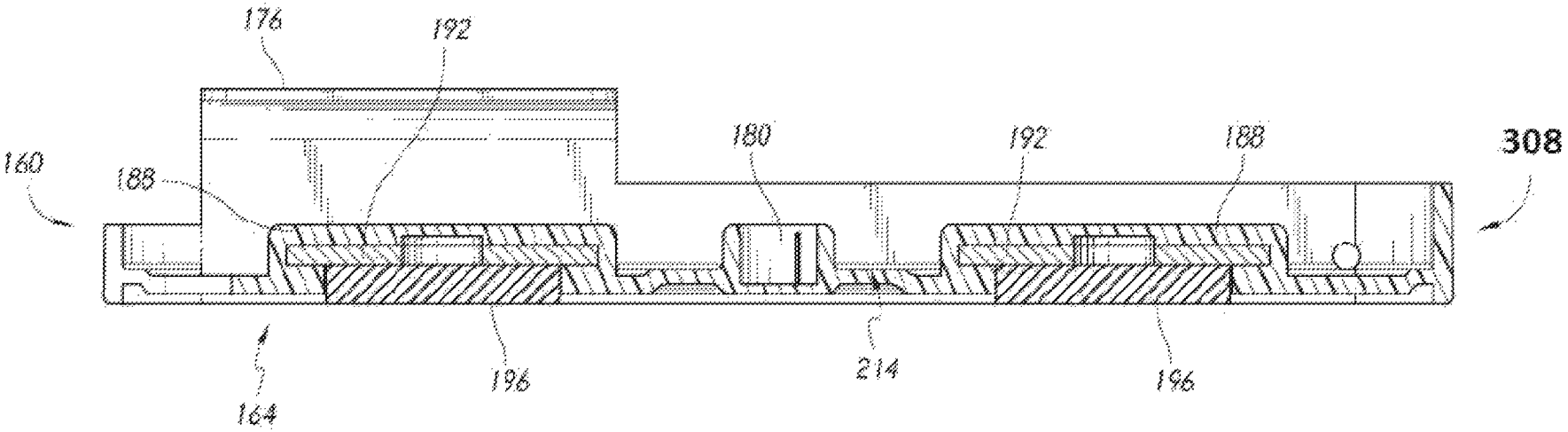
FIG. 4 is a cross-sectional view of the tray of the eraser assembly of FIG. 2.

Thereafter, the insert 310A, 310B, 310C can be mated with the recess 164 or 324. As shown in FIG. 4, in some embodiments, the tray 308 comprises a recess 180 configured to receive a magnet. The recess 180 can include an open end and a closed end. The open end can be accessible in or from the retaining portion. The magnet can be secured in the recess 180 in any suitable manner, such as by friction fit, interference fit, adhesives, or other conventional means. Also, the tray 308 can include a projection 188 housing a magnet retention feature. The projection 188 can be formed as an overmold entrapping a member 192 that is magnetically attracted to a magnet 196. The projection 188 preferably is configured such that the eraser insert 310 can rest thereon and be supported thereby. The magnet(s) 196 preferably have sufficient strength to support the eraser assembly 300 on a white board or a glass board or on another marking board.

As shown in FIGS. 3 and 5-7, the coupler 340 can include a first portion disposed on the housing 304 and a second portion disposed on the tray 308. In some embodiments, the aperture 380 is disposed between the first and second portions of the coupler 340. In some embodiments, the first portion of the coupler 340 can comprise an inner wall portion of the housing 304. The inner wall portion of the housing 304 can have a recess 344 or plurality of recesses 344A, 344B formed into it. In some embodiments, the second portion of the coupler 340 comprises a projection 348 or plurality of projections 348A, 348B disposed on the tray 308. In some embodiments, the second portion of the coupler 340 comprises an actuator 352 disposed on the tray 308. In some embodiments, the actuator 352 is configured to move the projection(s) 348 relative to the recess(es) 344. In some embodiments, the coupler 340 moves to the disengaged configuration when the user actuates the actuator 352, unlocking the tray 308 from the housing 304.

In some embodiments, the coupler 340 can comprise a pull 336. The actuator 352 can be configured as or can include a pull 336. The pull 336 is or includes a structure that is configured to be accessed by a finger of a user. The pull 336 can be accessed through an opening. The pull 336 is responsive to a pulling force by the user's finger to cause movement of the actuator 352. A flexible end can connect the pull 336 to a side surface of the tray 308. In some embodiments, the pull 336 is configured to move the coupler 340 from an engaged configuration to a disengaged configuration. The pull 336 can include an arcuate member disposed transverse to the flexible end. The pull 336 can be configured to move the projection 348 or other engagement feature out of the engaged position in order to allow the tray 308 to rotate away from the housing 304. In some embodiments, the coupler can include a projection(s) 348 opposite the arcuate member. The projection(s) 348 can be configured to engage an inner surface of the housing 304. In some embodiments, the projection(s) 348 can be disposed between the arcuate member and the flexible end.

Figure 10:
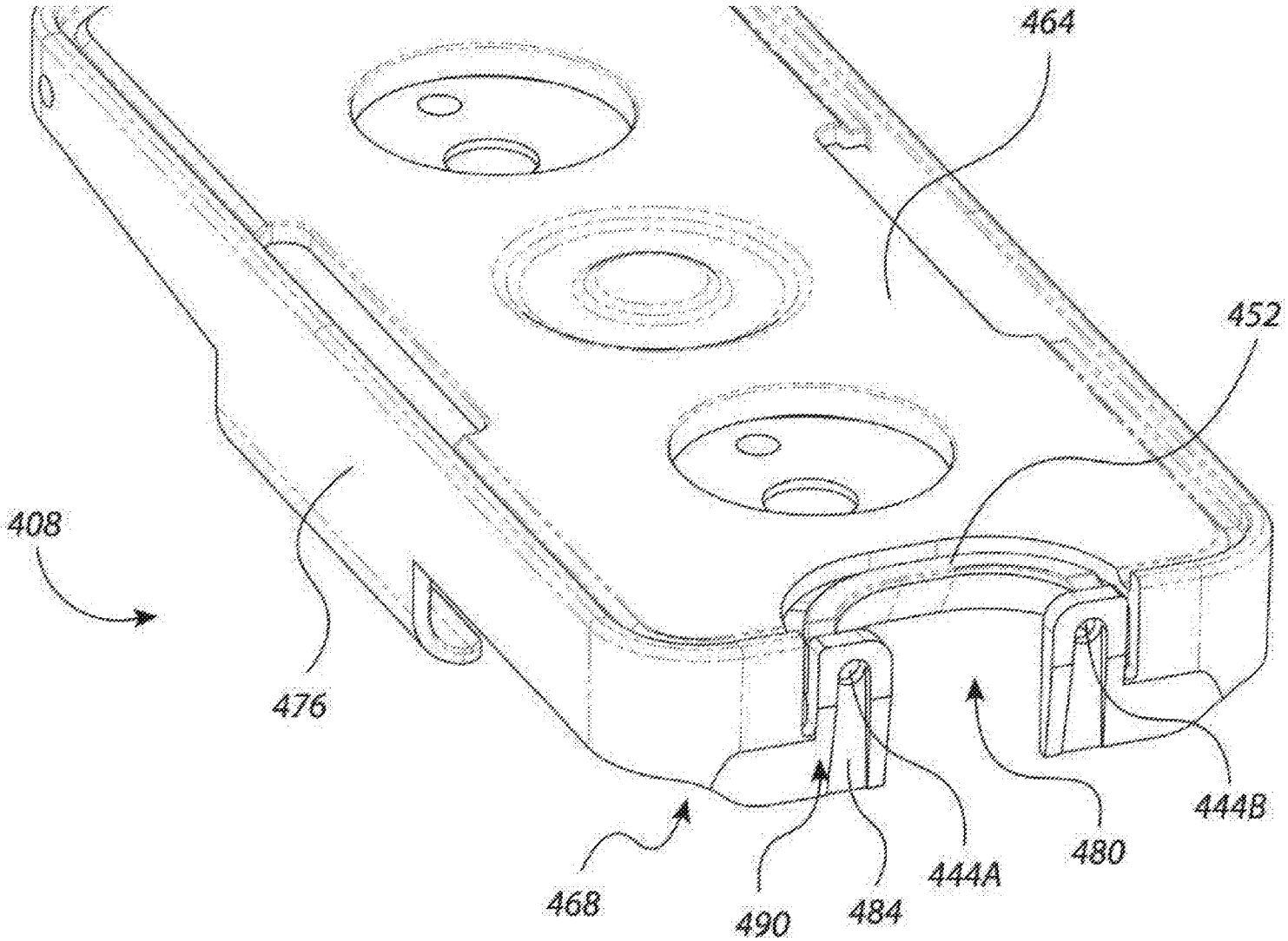
FIG. 10 is a detailed view of the tray of the eraser assembly of FIG. 8.

As shown in FIGS. 8-12, in some embodiments a first portion of a coupler comprises a projection or other feature disposed on an inner wall portion of the housing. A projection 448 or plurality of projections 448A, 448B can be formed on the inner wall portion of the housing 404. As shown in FIG. 10, in some embodiments, the second portion of the coupler 440 comprises a recess 444 or a plurality of recesses 444A, 444B disposed on the tray 408. In some embodiments, the second portion of the coupler 440 comprises an actuator 452 disposed on the tray 408. The actuator 452 can be configured to move the recess(es) 444 relative to the projection(s) 448. In some embodiments, the coupler 440 includes a first recess 444A and a second recess 444B. The first recess 444A and the second recess 444B can be disposed at opposite sides of the aperture 480.

As shown in FIG. 5, in some embodiments, the actuator 352 includes an arcuate member disposed about the aperture 380. The arcuate member can be flexibly coupled with a portion of the tray 308 to enable the coupler 340 to move to the disengaged configuration by withdrawing the projection(s) 348 from the recess(es) 344. In some embodiments, the arcuate member includes a first portion 354A located adjacent to the mounting portion 364 and a second portion 354B disposed away from the mounting portion 364. The second portion 354B of the arcuate member can connect to a side surface 358 of the tray 308. In some embodiments, the tray 308 includes a gap 356 disposed between the first portion 354A of the arcuate member and the adjacent mounting portion 364. In some embodiments, the second portion 354B of the arcuate member is bendable or flexible and enables the first portion 354A of the arcuate member to move toward the mounting portion 364 of the tray 308, decreasing the gap 356 between the first portion 354A of the arcuate member and the mounting portion 364.

As shown in FIGS. 6 and 7, the projection(s) 348 can comprise a first face 386A facing an enclosed end of the housing 304 and a second face 386B facing away from the enclosed end of the housing 304. In some embodiments, the first face of the projection 348 is disposed at an acute angle to the second face of the projection 348. This can provide a ramped surface 384 whereby the first face of the projection 348 deflects the actuator 352 away from the housing 304 when in contact with the housing 304 to enable the coupler 340 to move to an engaged configuration. The ramped surface 384 is advantageous because a blunt projection could prevent the tray 308 from rotating into engagement with the housing 304.

Figure 11:
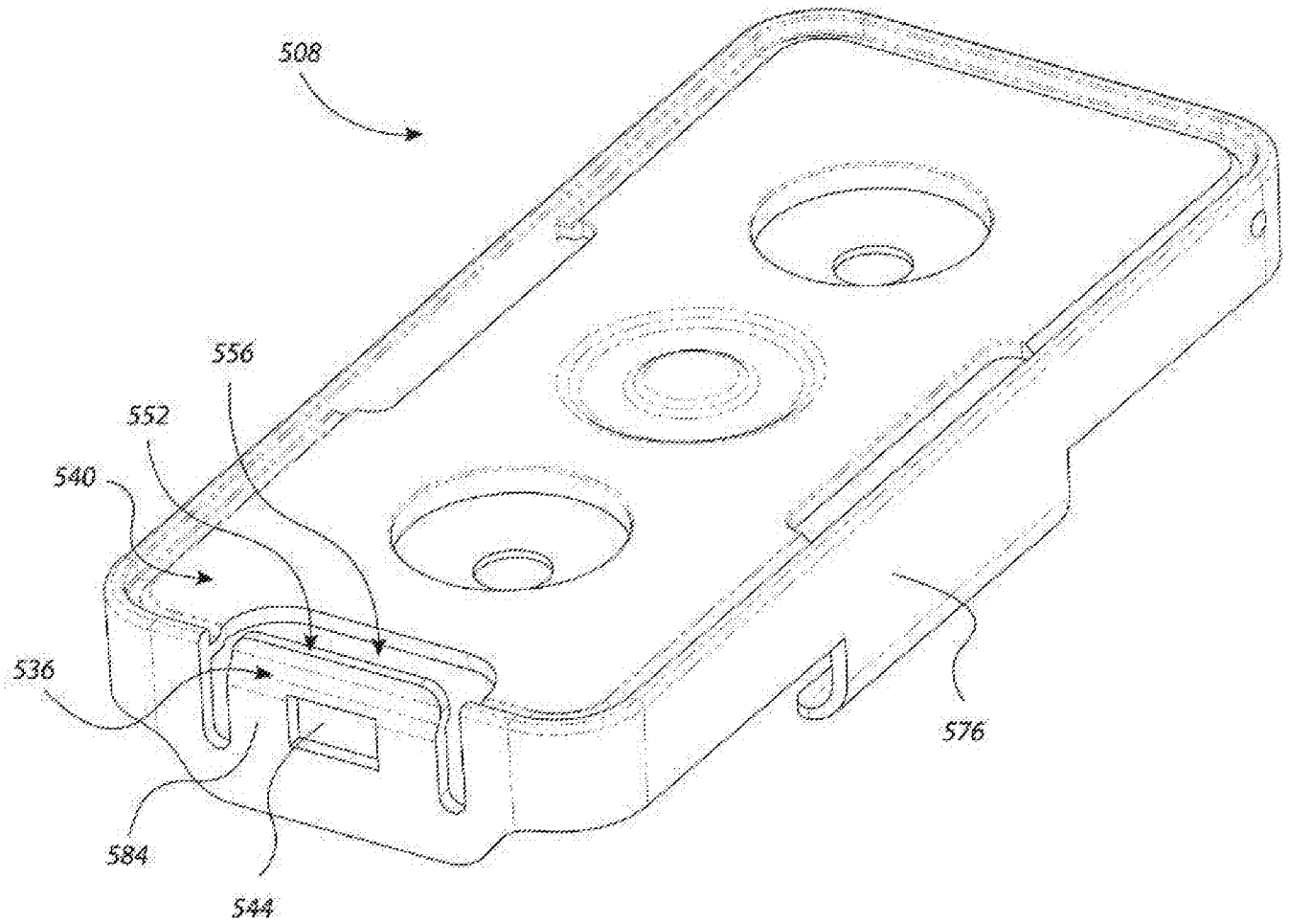
FIG. 11 is a perspective view of another embodiment of an eraser assembly.
Figure 12:
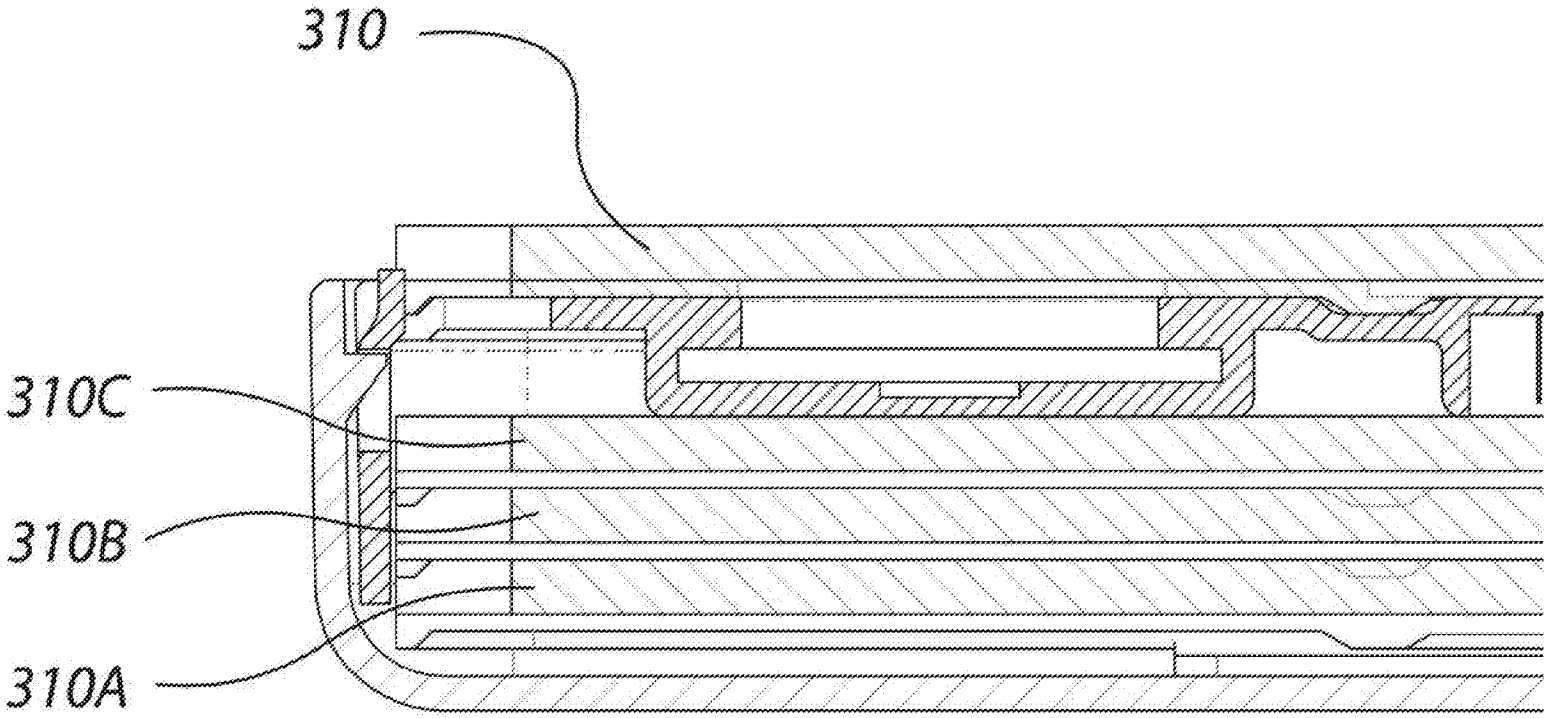
FIG. 12 is a schematic of the coupler of the eraser assembly of FIG. 11.
Figure 13:
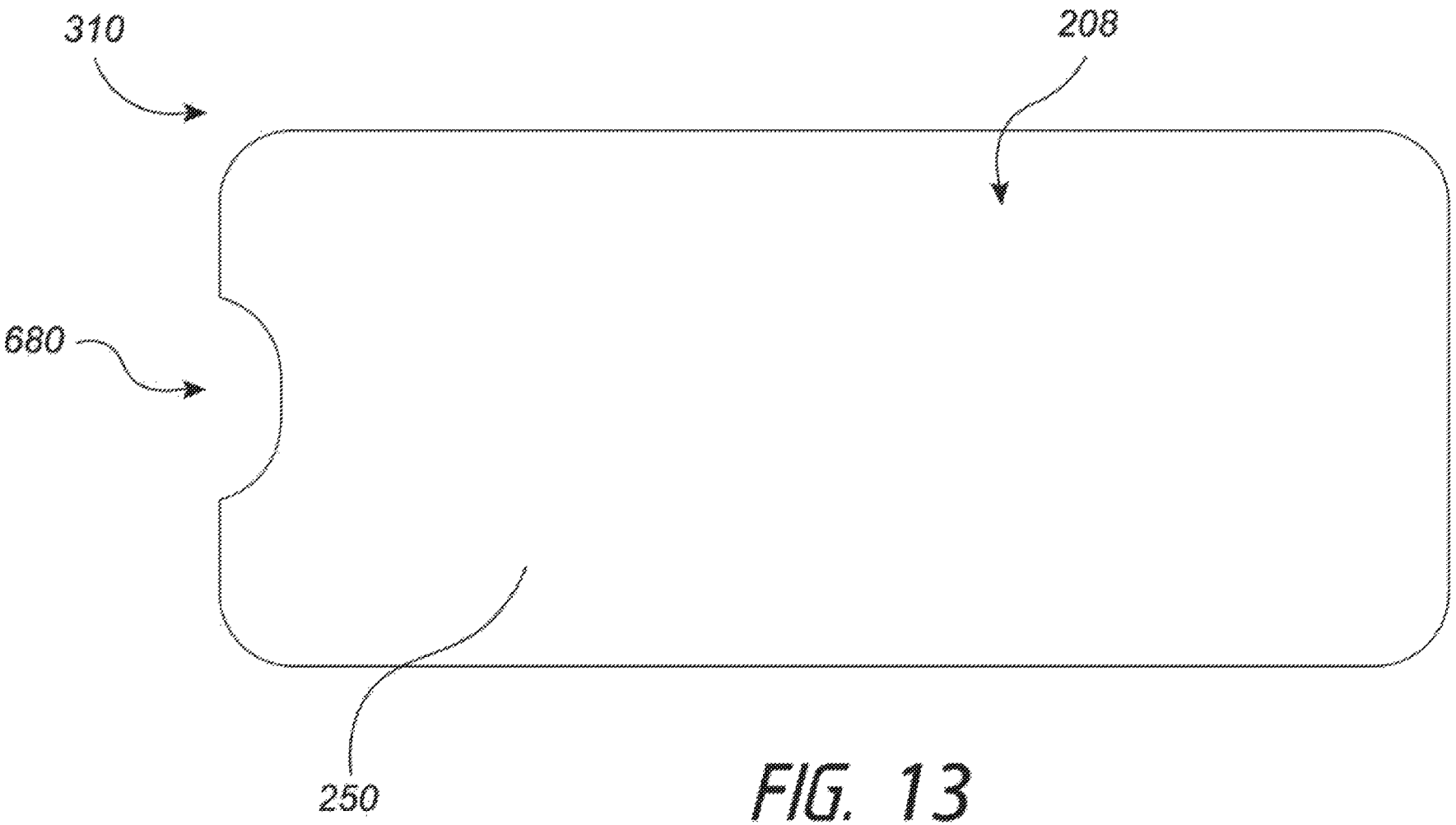
FIG. 13 is a bottom view of an embodiment of an eraser insert.

As shown in FIG. 10, the second portion of the coupler 440 comprises a recess 444 disposed on the tray 408. The recess 444 can be positioned on a ramped surface 484. The ramped surface 484 is deeper relative to the surface 490 away from the recess 444 than adjacent to the recess 444 and thus is configured to deflect the actuator 452 away from the housing 404 to enable the coupler 440 to move to an engaged configuration. The ramped surface 484 is advantageous because a perpendicular surface containing the recess 444 could prevent the tray 408 from rotating into engagement with the housing. Similarly, as shown in FIG. 11, the recess 544 can be disposed on a ramped surface 584.

FIGS. 13-16 illustrate embodiments of an eraser insert 310. In some embodiments, the eraser insert 310 can include a first side 204 and a second side 208 opposite the first side 204. The first side 204 can comprise an interface for mating with an eraser assembly and a coupler for detachably connecting the insert to an eraser assembly. The first side 204 can comprise a mounting surface 630. An eraser pad 250 made of felt, fabric, or any other material suitable for rubbing or wiping markings off of a board can be disposed on the second side 208.

Figure 14:
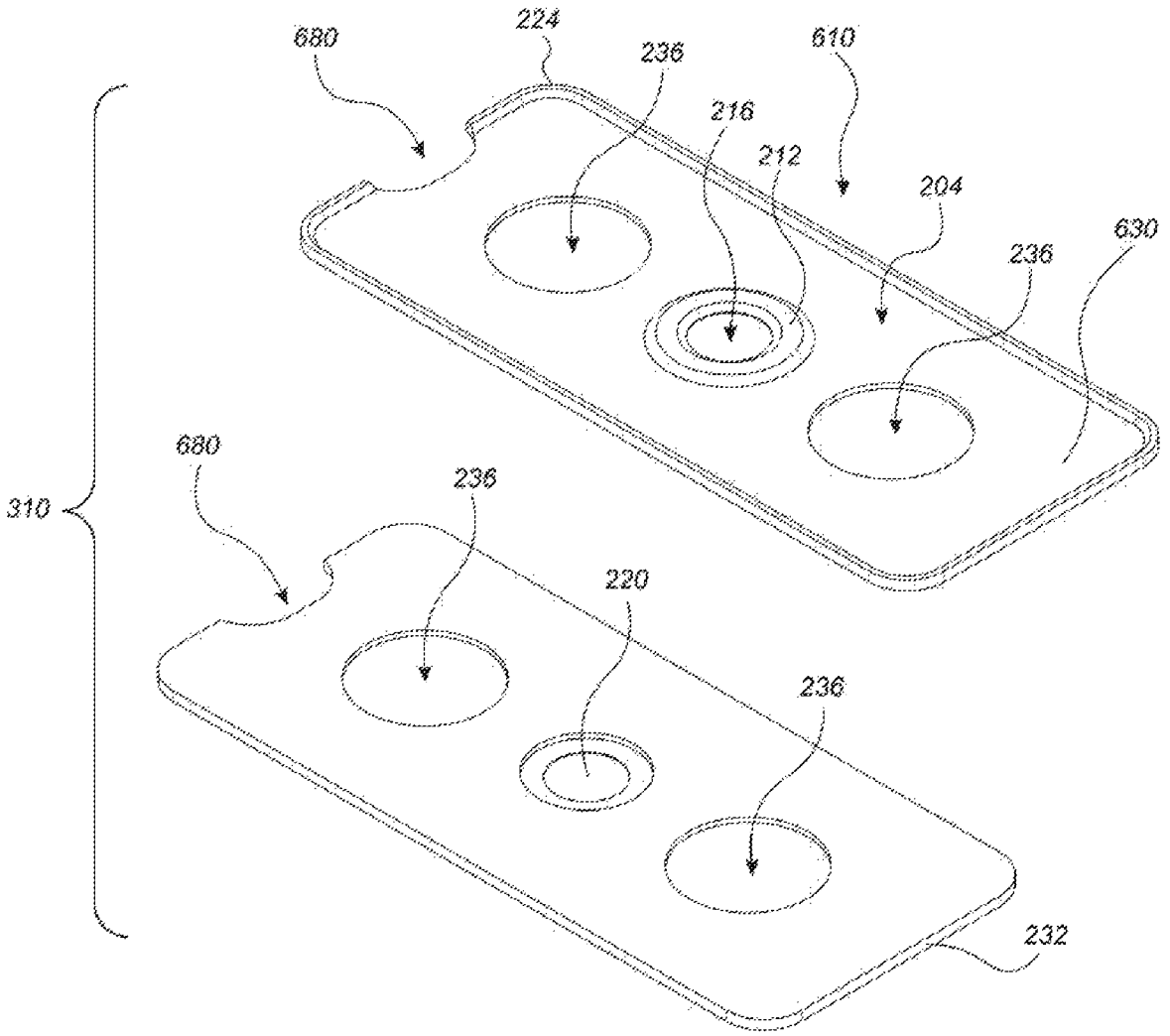
FIG. 14 is an exploded view of a base assembly of the eraser insert of FIG. 13.
Figure 15:
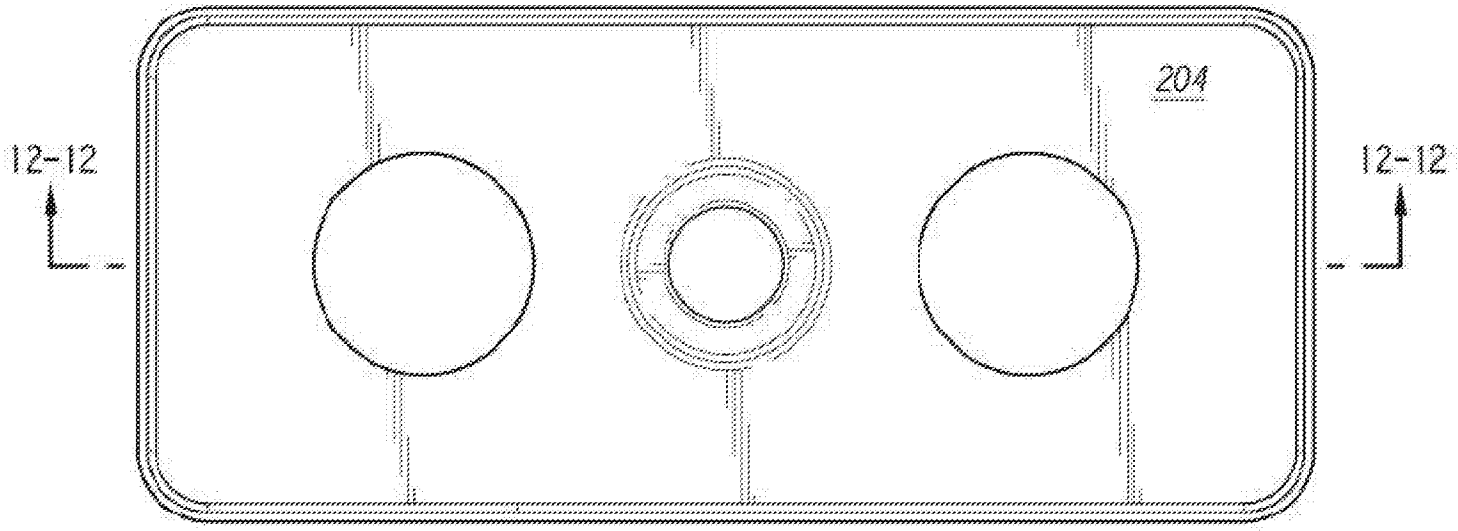
FIG. 15 is a top view of a tray interface of an eraser insert.
Figure 16:
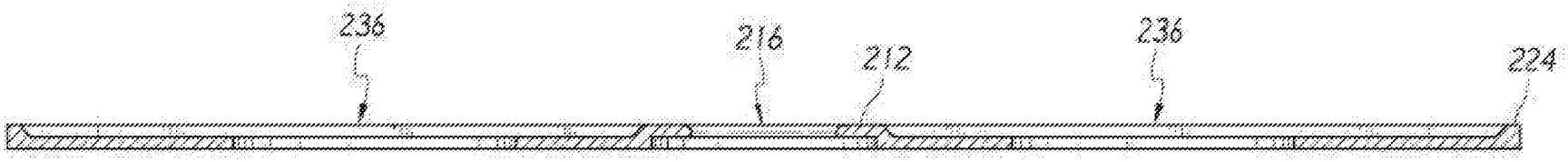
FIG. 16 is a cross-sectional view of the tray interface of FIG. 15 taken through the section plane 12-12.

As shown in FIG. 14, in some embodiments, the eraser insert 310 can include a pull, such as a concave aperture. A finger aperture 680 can be disposed at one end of the mounting surface 630 and/or eraser insert 310. The finger aperture 680 can extend from the first side 204 through the second side 208. In some embodiments, the finger aperture 680 can extend through a portion of the insert 310. The finger aperture 680 can be in the shape of a circle, half-circle, oval, square, or any other suitable shape. In some embodiments, the finger aperture 680 can be enclosed along its entire periphery. In some embodiments, the finger aperture 680 can be enclosed along a portion of its periphery.

In some embodiments, the eraser insert 310 can include a coupler disposed on or about the mounting surface 630. The coupler can be configured to detachably connect the eraser insert 310 to an eraser assembly at the mounting surface 630. In some embodiments, the coupler can include a hook and loop fastener, low strength adhesive, and/or magnet(s). In some embodiments, the coupler can comprise a first interface configured to resist transverse relative motion between the eraser insert 310 and an eraser assembly (generally in the directions indicated by arrows X and Y in FIG. 2). In some embodiments, the coupler can comprise a second interface configured to resist dislodgment or detachment of the eraser insert 310 away from an eraser assembly (generally in the direction indicated by arrow Z in FIG. 2).

In some embodiments, the coupler comprises a projection located on the first side 204 and extending away from the second side 208 of the insert 310. The projection can be disposed on at least two transverse portions of the first side 204 of the insert 310. For example, the projection can comprise a rim located on the same side of the insert 310 as the finger aperture 608 and on a long side of the insert 310 adjacent to the finger aperture. The projection can comprise a rim located on an opposite side of the insert 310 from the finger aperture 680 and on a long side of the insert 310 adjacent to the finger aperture. The projection can comprise a rim located on both sides of the finger aperture 680 and on a long side of the insert 310 adjacent to the finger aperture. The projection can comprise a rim located on three or more sides of the first side 204 of the insert 310. The projection can be disposed about an entire periphery of the first side 204. The projection can comprise a peripheral rim 224 projecting away from the mounting surface 630. The peripheral rim 224 can be disposed on a rigid plate-like body or plate body 610. The peripheral rim 224 can be received in and retained in a peripheral recess or well of an eraser assembly. For example, an eraser assembly may receive the peripheral rim 224 in a recess 324 as shown in FIGS. 3 and 5. This can aid in resisting relative motion or opposing dislodgment between the eraser insert 310 and an eraser assembly due to transverse motion, friction, or other loading generally in the plane of the side 208.

The projection can comprise an annular region 212 projecting away from the mounting surface 630. The annular region 212 can be disposed inward of an outer periphery of the first side 204. As shown in FIG. 14, in some embodiments, an annular region 212 can surround an aperture 216. The annular region 212 can be received in a recess or well in an eraser assembly.

The coupler can comprise a member 220 configured to magnetically attract the eraser insert 310 to an eraser assembly. The aperture 216 can allow a member 220, such as a steel member or other magnetically attractable member, to be exposed on the first side 204. The member 220 can be configured to provide releasable connection between the eraser insert 310 and an eraser assembly. The member 220 can be in the shape of a circular disc, square, or any other suitable shape. In some embodiments, the member 220 can comprise a steel annulus disposed between the mounting surface 630 and the second side 208 of the insert 310. The member 220 can be enclosed by a layer 232 disposed between the first side 204 and the second side 208.

Although the member 220 can be disposed below or adjacent to a projection, it could also be flush with a planar or flat portion of the first side 204 while still providing for a magnetic attraction or coupling of the insert 310 to the mounting portion 364.

In some embodiments, an eraser insert 310 can have a three layer structure. In some embodiments, the eraser insert 310 can have a plate body 610 disposed on the first side 204 and an intermediate layer 232 disposed between the plate body 610 and the eraser pad or layer 250. One side of the layer 250 can include an adhesive for connecting layer 250 to layer 232. One or both of the plate body 610 and layer 232, or any other suitable component, can include an aperture or apertures 236. In some embodiments, the aperture(s) 236 can be disposed on the mounting surface 630. In some embodiments, the aperture(s) 236 are configured to receive a magnet portion of an eraser assembly such that a pole of the magnet portion can be advanced to a position between the first side 204 and the second side 208. For example, the aperture(s) 236 can be configured to permit magnet(s) of an eraser assembly to protrude through the eraser insert 310 such that the distance between the magnet(s) and a board to which an eraser assembly can be magnetically mounted is shorter than had the magnet(s) been entirely disposed between the first side 204 and components of an eraser assembly. In some embodiments, the insert 310 can comprise a hook and loop fastener surrounding the aperture(s) 236.

In some embodiments, the layers 232 and 250 can be a single layer in which aperture(s) 236 in the layer 232 are recesses that extend only partially through the single layer. The member 220 can rest on the combined layer providing a smooth second side 208 where the presence of the member 220, or components of an eraser assembly, is not apparent. This reduces the chance of direct contact between these components and a marking board which could potentially result in scratches or other damage to the marking board.

ADDITIONAL EXAMPLES

In a first example, an eraser assembly comprises a housing comprising a concave shape including an interior portion, a tray comprising a retaining portion disposed in the interior portion and a mounting portion disposed opposite of the retaining portion, a coupler configured to releasably hold the tray to the housing, and an eraser insert configured to be mounted to the mounting portion.

In a second example, the eraser assembly of the first example comprises an aperture for accessing the interior portion of the housing to disengage the coupler.

In a third example, the aperture of the second example extends through the eraser insert into the interior portion of the housing.

In a fourth example, the coupler of the second example comprises a first portion disposed on the housing and a second portion disposed on the tray, the aperture being disposed between the first portion and the second portion of the coupler.

In a fifth example, the first portion of the fourth example comprises an inner wall portion of the housing and a recess formed into the inner wall portion of the housing and the second portion comprises a projection and an actuator disposed on the tray, the actuator configured to move the projection relative to the recess.

In a sixth example, the coupler of the fifth example has a first engaged configuration and a second disengaged configuration, and the actuator comprises an arcuate member disposed about the aperture, the arcuate member being flexibly coupled with a portion of the tray to enable the coupler to move to the disengaged configuration by withdrawing the projection from the recess.

In a seventh example, the arcuate member of the sixth example comprises a first portion located adjacent to the mounting portion and a second portion disposed away from the mounting portion and connected to a side surface of the tray, tray further comprising a gap disposed between the first portion of the arcuate member and the adjacent mounting portion, the second portion of the arcuate member being bendable to enable the first portion to move toward the mounting portion of the tray to decrease the gap.

In an eighth example, the projection of the sixth example comprises a first face facing an enclosed end of the housing and a second face facing away from the enclosed end of the housing, the first face disposed at an acute angle to the second face providing a ramped surface whereby the first face deflects the actuator away from the housing to enable the coupler to move to an engaged configuration.

In a ninth example, the coupler of the first example comprises a pull and a flexible end connecting the pull to a side surface of the tray, the pull configured to move the coupler from an engaged configuration to a disengaged configuration.

In a tenth example, the pull of the ninth example comprises an arcuate member disposed transverse to the flexible end.

In an eleventh example, the coupler of the tenth example comprises a projection opposite the arcuate member configured to engage an inner surface of the housing.

In a twelfth example, the coupler of the tenth example comprises a projection between the arcuate member and the flexible end.

In a thirteenth example, the first portion of the coupler of the fourth example comprises an inner wall portion of the housing and a projection formed on the inner wall portion of the housing and the second portion of the coupler can comprise a recess and an actuator disposed on the tray, the actuator configured to move the recess relative to the projection.

In a fourteenth example, the recess of the thirteenth example comprises a first recess and further comprises a second recess, the first and second recesses being disposed at opposite ends of the aperture.

In a fifteenth example, an eraser insert comprises a first side comprising a mounting surface and a second side, an eraser pad disposed on the second side, and a coupler disposed on or about the mounting surface, the coupler configured to detachably connect the eraser insert to an eraser assembly at the mounting surface.

In a sixteenth example, the eraser insert of the fifteenth example further comprises a plate body disposed on the first side and an intermediate layer disposed between the plate body and the eraser pad.

In a seventeenth example, the plate body of the sixteenth example comprises a peripheral rim configured to be received in a peripheral recess of an eraser assembly to resist relative motion between the eraser insert and an eraser assembly.

In an eighteenth example, the coupler of the fifteenth example comprises a first interface configured to resist transverse relative motion between the eraser insert and an eraser assembly and a second interface configured to resist detachment of the eraser insert away from an eraser assembly.

In a nineteenth example, the coupler of the fifteenth example comprises a projection extending away from the second side.

In a twentieth example, the projection of the nineteenth example is disposed on at least two transverse portions of the first side.

In a twenty-first example, the projection of the nineteenth example comprises a peripheral rim projecting away from the mounting surface and being disposed about an entire periphery of the first side.

In a twenty-second example, the projection of the nineteenth example comprises an annular region projecting away from the mounting surface disposed inward of an outer periphery of the first side.

In a twenty-third example, the coupler of the fifteenth example comprises a member configured to magnetically attract the eraser insert to an eraser assembly.

In a twenty-fourth example, the member of the twenty-third example comprises a steel annulus disposed between the mounting surface and the second side.

In a twenty-fifth example, the mounting surface of the fifteenth example comprises an aperture configured to receive a magnet portion of an eraser assembly such that a pole of the magnet portion can be advanced to a position between the first side and the second side.

In a twenty-sixth example, the coupler of the twenty-fifth example comprises a hook and loop fastener surrounding the aperture.

In a twenty-seventh example, the coupler of the fifteenth example comprises a hook and loop fastener.

In a twenty-eighth example, the eraser insert of the fifteenth example further comprises a pull extending through at least one of the first side and the second side of the eraser insert.

In a twenty-ninth example, the pull of the twenty-eighth example comprises a concave aperture disposed at one end of the eraser insert.

As used herein, the relative terms "top" and "bottom" shall be defined from the perspective of what is visible to the user when the eraser assembly is held around the housing 304. Thus, top refers the direction toward the exposed side of the housing 304 farthest from the side 608, while bottom refers to the direction toward the side 608.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An eraser insert, comprising:

a first side comprising a mounting surface having a central portion and a peripheral portion and a second side;

an eraser pad disposed on the second side;

a pull access aperture at an end of the eraser insert extending through the eraser insert, the pull access aperture having a first edge, a second edge opposite the first edge and an opening disposed therebetween;

a continuous rim disposed in the peripheral portion of the mounting surface, the continuous rim extending continuously from a first end at the first edge of the pull access aperture to a second end at the second edge of the access aperture;

an annular region disposed within the central portion and spaced away from the continuous rim, the annular region projecting from the first side and in a direction away from the second side; and a magnetically attractable member retained by the annular region with a thickness of the magnetically attractable member extending in a direction between the first side and the second side and a width of the magnetically attractable member aligned with the mounting surface;

the magnetically attractable member and the continuous rim configured to detachably connect the eraser insert to an eraser assembly at the mounting surface by magnetic attraction of the magnetically attractable member to a corresponding magnetically attractable member disposed in the eraser assembly and by positioning of the continuous rim within a corresponding recess of the eraser assembly.

2. The eraser insert of claim 1, further comprising a plate body disposed on the first side and an intermediate layer disposed between the plate body and the eraser pad.

3. The eraser insert of claim 2, wherein the continuous rim is disposed on the plate body and is configured to be received in a peripheral recess of an eraser assembly to resist relative motion between the eraser insert and an eraser assembly.

4. The eraser insert of claim 1, wherein the continuous rim comprises a first interface configured to resist transverse relative motion between the eraser insert and an eraser assembly and the magnetically attractable member of the eraser insert comprises a second interface configured to resist detachment of the eraser insert away from an eraser assembly.

5. The eraser insert of claim 1, wherein the continuous rim extends along an end of the eraser insert opposite to the pull access aperture and along lateral edges of the eraser insert.

6. The eraser insert of claim 1, wherein the annular region is disposed within the continuous rim.

7. The eraser insert of claim 1, wherein the annular region comprises an opening through which the magnetically attractable member is exposed on the first side projecting away from the mounting surface disposed inward of an outer periphery of the first side.

8. The eraser insert of claim 1, wherein the mounting surface comprises an aperture configured to receive a magnet portion of an eraser assembly such that a pole of the magnet portion can be advanced to a position between the first side and the second side.

9. The eraser insert of claim 1, wherein the pull access aperture comprises a concave aperture disposed through the peripheral portion at one end of the eraser insert.

10. An eraser assembly, comprising:

a housing comprising a concave shape including an interior portion;

a tray comprising a retaining portion disposed in the interior portion and a mounting portion disposed opposite of the retaining portion;

a coupler configured to releasably hold the tray to the housing; and the eraser insert of claim 1 configured to be mounted to the mounting portion.

11. The eraser assembly of claim 10, wherein the eraser assembly comprises an aperture for accessing the interior portion of the housing to disengage the coupler.

12. The eraser assembly of claim 11, wherein the aperture extends through the pull access aperture of the eraser insert into the interior portion of the housing.

13. The eraser assembly of claim 11, wherein the coupler comprises a first portion disposed on the housing and a second portion disposed on the tray, the aperture being disposed between the first portion and the second portion of the coupler.

14. The eraser assembly of claim 13, wherein the first portion comprises an inner wall portion of the housing and a recess formed into the inner wall portion of the housing and the second portion comprises a projection and an actuator disposed on the tray, the actuator configured to move the projection relative to the recess.

15. The eraser assembly of claim 14, wherein the coupler has a first engaged configuration and a second disengaged configuration, and the actuator comprises an arcuate member disposed about the aperture, the arcuate member being flexibly coupled with a portion of the tray to enable the coupler to move to the disengaged configuration by withdrawing the projection from the recess.

16. The eraser assembly of claim 15, wherein the arcuate member comprises a first portion located adjacent to the mounting portion and a second portion disposed away from the mounting portion and connected to a side surface of the tray, tray further comprising a gap disposed between the first portion of the arcuate member and the adjacent mounting portion, the second portion of the arcuate member being bendable to enable the first portion to move toward the mounting portion of the tray to decrease the gap.

17. The eraser assembly of claim 15, wherein the projection comprises a first face facing an enclosed end of the housing and a second face facing away from the enclosed end of the housing, the first face disposed at an acute angle to the second face providing a ramped surface whereby the first face deflects the actuator away from the housing to enable the coupler to move to an engaged configuration.

18. The eraser assembly of claim 10, wherein the coupler comprises a pull and a flexible end connecting the pull to a side surface of the tray, the pull configured to move the coupler from an engaged configuration to a disengaged configuration.

19. The eraser assembly of claim 18, wherein the pull comprises an arcuate member disposed transverse to the flexible end.

20. The eraser assembly of claim 13, wherein the first portion of the coupler comprises an inner wall portion of the housing and a projection formed on the inner wall portion of the housing and the second portion of the coupler comprises a recess and an actuator disposed on the tray, the actuator configured to move the recess relative to the projection.

* * * * *